United States Patent [19]

Kakizaki

[11] Patent Number: 4,728,855

[45] Date of Patent: Mar. 1, 1988

[54] VERTICAL AND HORIZONTAL DEFLECTION ELECTRODES FOR ELECTROSTATIC DEFLECTION TYPE CATHODE RAY TUBE

[75] Inventor: Takehiro Kakizaki, Kanagawa, Japan

[73] Assignee: Sony Corporation, Tokyo, Japan

[21] Appl. No.: 803,018

[22] Filed: Nov. 29, 1985

[30] Foreign Application Priority Data

Nov. 28, 1984 [JP] Japan ..... 59-251272

[51] Int. Cl.[4] ..... H01J 29/74

[52] U.S. Cl. ..... 313/435; 313/439; 313/432

[58] Field of Search ..... 313/435, 450, 439, 436, 313/432, 434

[56] References Cited

U.S. PATENT DOCUMENTS 2,681,426 6/1954 Schlesinger ..... 313/436 X
2,770,748 11/1956 Schlesinger et al. ..... 313/435
2,904,712 9/1959 Schlesinger ..... 313/435
3,731,136 5/1973 Roussin ..... 313/434 X
3,796,910 3/1974 Ritz, Jr. ..... 313/450 X

*Primary Examiner*—Palmer C. DeMeo
*Attorney, Agent, or Firm*—Hill, Van Santen, Steadman & Simpson

[57] ABSTRACT

An improved vertical and horizontal deflection electrode system for an electrostatic deflection cathode ray tube which comprises a glass bulb and an electron beam source and vertical and horizontal deflection electrodes formed in patterns and which are applied to the inner surface of the glass bulb and wherein the ratio of the area of the vertical deflection electrodes to the area of the horizontal deflection electrodes is selected to be approximately equal to the deflection aspect ratio of the electron beam and the horizontal and vertical directions which results in the voltage required in the deflection system being substantially decreased.

5 Claims, 6 Drawing Figures

VERTICAL AND HORIZONTAL DEFLECTION ELECTRODES FOR ELECTROSTATIC DEFLECTION TYPE CATHODE RAY TUBE

BACKGROUND OF THE INVENTION

1. Field of the Invention

The present invention relates to an electrostatic deflection type cathode ray tube which has vertical and horizontal deflection electrodes which are formed in various patterns and applied to the inner surfaces of a glass bulb.

2. Description of the Prior Art

FIG. 4 is an example of a typical image pickup tube of the prior art of the magnetic focus/electrostatic deflection type and illustrates a glass bulb 1 which has a face plate 2 and a target surface 3 (photoelectric conversion surface) and an indium seal 4 for cold sealing and a metal ring 5. A signal removing metal electrode 6 passes through the face plate 2 and makes electrical contact with the target surface 3.

A cathode K is mounted in the bulb and a first grid electrode G1 and a second grid electrode G2 form an electron gun. A beam limiting aperture LA is formed in the grid G2 so as to limit the angle of divergence of the electron beam $B_m$.

A third electrode G3 forms a deflection electrode and the electrode G3 is made with a process wherein metal such as chromium or the like is evaporated or plated on the inner surface of the glass bulb 1 and then prescribed patterns are formed by means of cutting using a laser beam or other cutting means so as to form vertical deflection electrodes V+ and V− and horizontal deflection electrodes H+ and H−. The vertical and horizontal deflection electrodes are formed in a so-called leaf pattern as illustrated in FIG. 5 or in so-called arrow patterns as illustrated in FIG. 6.

In FIGS. 5 and 6, gaps between the electrodes without metal coating are illustrated by black lines for simplification of the drawings. In FIG. 5, the hatched portions are unrequired portions to which, for example, the center voltage of the deflection voltage is applied. In FIG. 6, the hatched portions are surplus portions and are averaged in the axial direction between the electrodes H+ and H− and between the electrodes V+ and V−. Since the electrodes V+, V−, H+ and H− are formed in the patterns illustrated, the areas become cosine distributions with respect to the circumferential direction and thereby uniform deflection fields are obtained.

In FIG. 4 a mesh electrode G4 is supported by a mesh holder 7 and a focusing coil 8 is mounted external of the bulb 1 and a stem pin 9 extends through the bulb 1.

In the prior art image pickup tube with the patterns illustrated in FIGS. 5 and 6 for the electrode G3 which shows the individual electrodes V+, V− and H+ and H− which have the same area and shape, the deflection sensitivity is equalized in the vertical direction and the horizontal direction.

In an actual tube, the deflection scanning of the electron beam $B_m$ the aspect ratio is not 1:1 but is 4:3 or 5:3. Thus, if the deflection sensitivity is made to be equal in the vertical and horizontal directions as in the prior art tubes, a circuit to drive the deflection electrodes requires that the deflection source voltage be sufficient to drive the larger deflection direction and elements must be provided which can withstand the required voltage. For example, when scanning with an aspect ratio of 5:3, if the vertical deflection voltage is 100 volts (peak-to-peak) the horizontal deflection voltage must be 167 V (peak-to-peak) and the deflection source voltage must be 167 V+2. For this case, a surplus voltage is produced for the vertical deflection and it is not preferable from the viewpoint of maintaining low power consumption.

If the deflection sensitivity is selected to be 1.3 times in the horizontal direction and 1/1.3 times in the vertical direction without varying the overall length of the deflection electrode G3, the deflection voltage will be about 130 volts (peak-to-peak) in the horizontal direction and the vertical direction which thereby decreases the source voltage and results in lower power consumption and the breakdown voltage of the circuit elements may be selected to be lower.

SUMMARY OF THE INVENTION

It is an object of the present invention to provide an improved cathode ray tube of the electrostatic deflection type in which the deflection source voltage is decreased so as to reduce the power consumed and the breakdown voltage of the circuit elements which results in improved tubes as compared to the prior art devices.

In the invention, the area ratio of the vertical and horizontal deflection electrodes are made to be approximately equal to the deflection aspect ratio of the electron beam. For example, when scanning with an aspect ratio of 5:3, the ratio of the area in the horizontal deflection electrodes H+ and H− to the area of the vertical deflection electrodes V+, V− is made to equal 5:3.

Since the deflection sensitivity in the vertical direction and the horizontal direction is made equal to the deflection aspect ratio of the electron beam, the deflection sensitivity is increased in the direction of the larger deflection angle and, thus, the deflection source voltage may be decreased.

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure.

DESCRIPTION OF THE PREFERRED EMBODIMENTS

Figure 1:
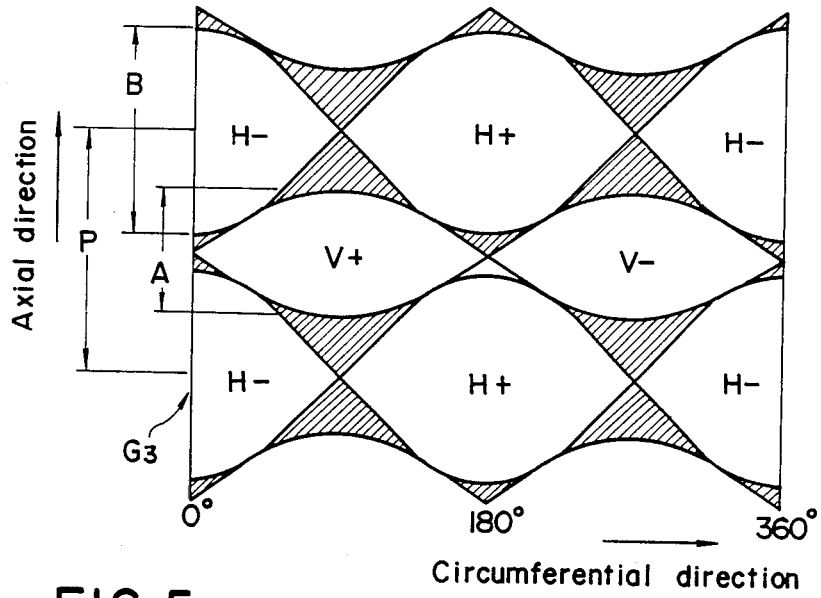
FIG. 1 is a plan view of a development of the deflection electrode of the invention.
Figure 2:
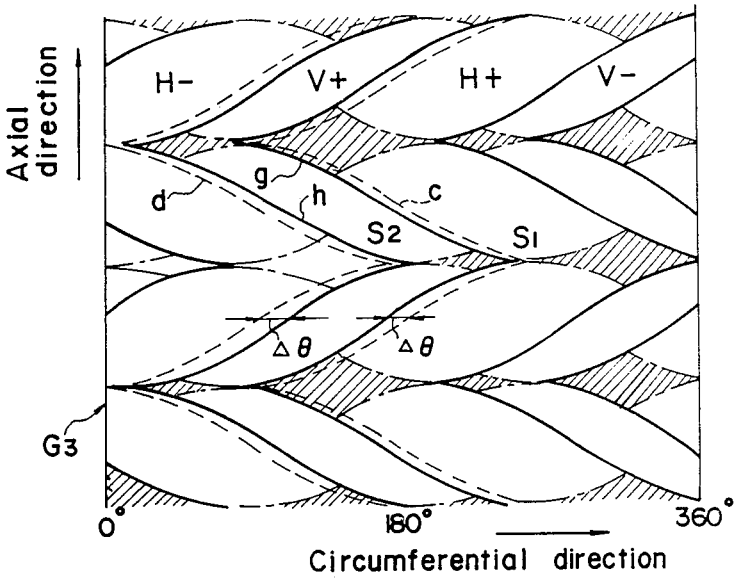
FIG. 2 is a modification of the invention and illustrates the development of a deflection electrode according to the invention.
Figure 4:
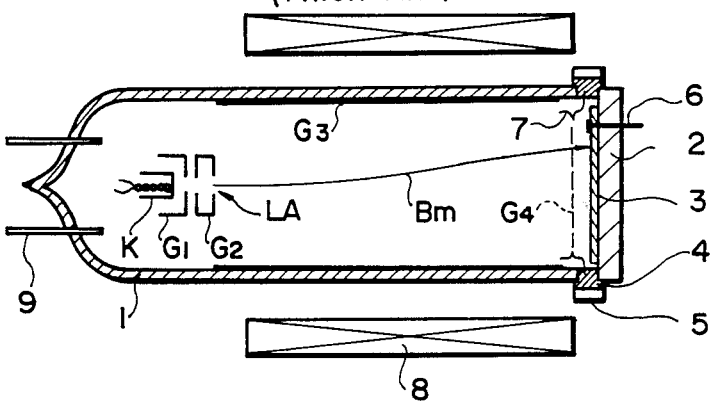
FIG. 4 (PRIOR ART)
FIG. 4 is a sectional view of an image pickup tube of the magnetic focus/electrostatic deflection type.

FIGS. 1 and 2 illustrate different embodiments of the electrode G3 which can be mounted in a tube illustrated in FIG. 4. FIG. 1 illustrates leaf patterns according to the invention. In FIG. 1, the ratio of the area of the horizontal deflection electrodes H+, H− to the area of the vertical deflection electrodes V+ and V− is made to be equal to the aspect ratio. FIGS. 1 and 2 are two dimensional developments of the cylindrical shaped electrode G3 and the axial and circumferential directions of the layouts are illustrated. In FIG. 1, the width B of the horizontal deflection electrodes and the width A of the vertical deflection electrodes are proportional to the total area of the horizontal and vertical electrodes and, thus, the desired ratio can be obtained by selecting the width B and A so that their ratio is nearly equal to the aspect ratio which is desired. The deflection sensitivity varies proportional to the areas of the deflection electrodes.

Figure 5:
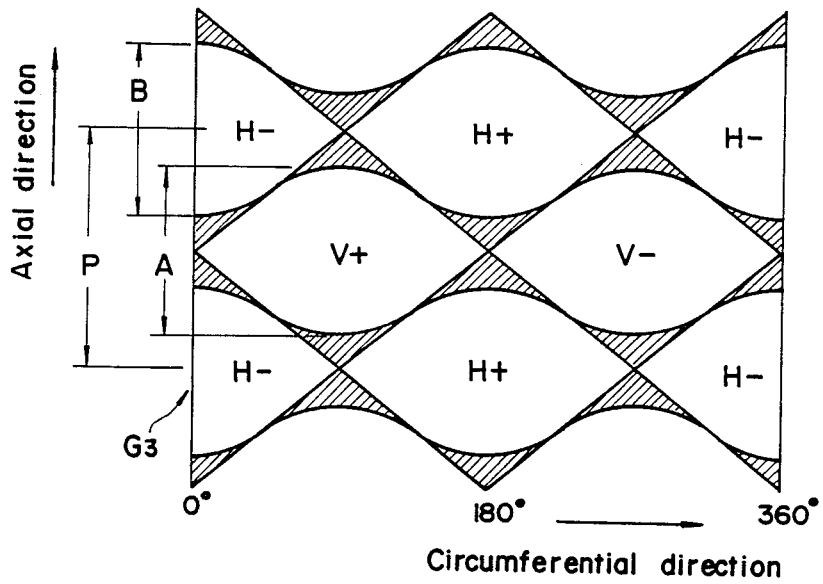
FIG. 5 (PRIOR ART)
FIG. 5 is a development of the deflection electrode in leaf patterns used in the prior art and FIG. 6 is a development of a deflection electrode in arrow patterns of the prior art.

If the desired aspect ratio is 5:3 and if the pitch of the patterns is represented by P, it follows that B/P will equal 0.857 and A/P will be 0.514. In the prior art as illustrated in FIG. 5 wherein A and B are equal, A/P equals B/P equals $1\sqrt{2}$ equals 0.707. Thus, in the present invention, the area of the horizontal deflection electrodes H+, H− is selected to be 1.21 times as large as the horizontal deflection electrodes of the prior art and the increase of the deflection sensitivity becomes 1.21 times that of the prior art.

If the aspect ratio is 4:3, it follows that B/P equals 0.80 and a A/P equals 0.60. Consequently, the area of the horizontal electrodes H+ and H− will be 1.13 times as large as the horizontal electrodes of the prior art and the increase of the deflection sensitivity will be 1.13 times that of the prior art.

FIG. 1 illustrates the size of the horizontal and vertical deflection electrodes for the aspect ratio of 5:3 for a leaf pattern.

FIG. 2 illustrates the construction of the electrode G3 for a arrow pattern and in FIG. 2, the ratio of the area of the horizontal deflection electrodes H+ and H− to the area of the vertical deflection electrodes V+ and V− is made equal to the aspect ratio of the tube.

Figure 6:
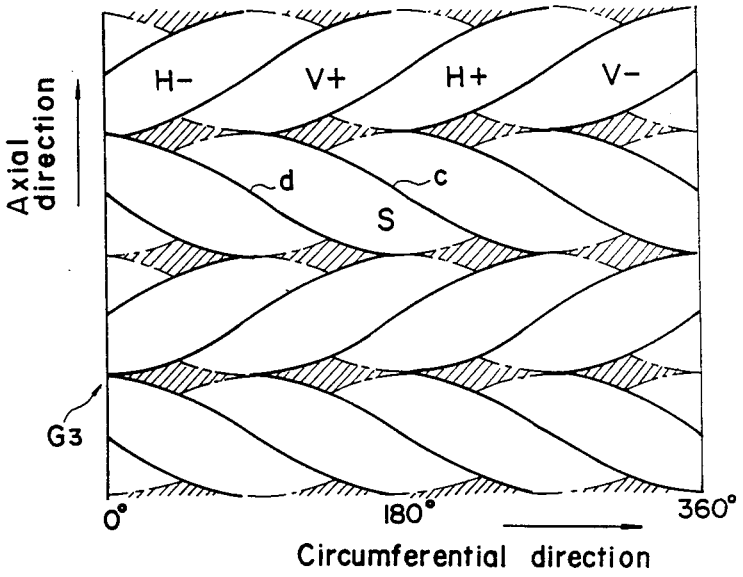
FIG. 6 (PRIOR ART)

FIG. 6 illustrates an electrode of the prior art of the arrow form and the area S of a portion surrounded by the curve c and curve d becomes $$S = \cos(\theta + \theta_o) - \cos(\theta + \theta_o + 90°) - \quad (1)$$

$$2\sin(\theta + \theta_o + 45°) \cdot \sin(-45°)\sqrt{2}\ \sin(\theta + \theta_o + 45°)$$

where $\theta_o$ is a constant. The area distribution is a sinusoidal form as illustrated in formula (1) which is the basic principle of arrow patterns.

As shown in FIG. 2, the curve c is shifted to the left by $\Delta\theta$ relative to curve c in FIG. 6 and is shown by curve g and curve d is shifted to the right by $\Delta\theta$ and is shown by curve h. That is to say the boundaries between the electrodes H+ and V+ and H− and V− are shifted to the left relative to the FIG. by $\Delta\theta$ and the boundaries between the electrodes V+ and H− and V− and H+ are shifted to the right by $\Delta\theta$ so that the ratio of the area of the electrodes H+ and H− to the area of the electrode V+ and V− comes nearly equal to the aspect ratio.

The area S1 of the electrodes H+ and H− becomes $$S_1 = \cos(\theta + \theta_1 - \Delta\theta) - \cos(\theta + \theta_1 + 90° + \Delta\theta) \quad (2)$$

$$= -2\sin(\theta + \theta_1 + 45°)\sin(-45° - \Delta\theta)$$

$$= 2(\sin 45° \cos\Delta\theta + \cos 45° \sin\Delta\theta)\sin(\theta + \theta_1 + 45°)$$

-continued $$= 2(\cos\Delta\theta + \sin\Delta\theta)\sin(\theta + \theta_1 + 45°)$$

Similarly, the area $S_2$ of the electrodes V+ and V− becomes $$S_2 = \cos(\theta + \theta_2 + \Delta\theta) - \cos(\theta + \theta_2 + 90° - \Delta\theta) \quad (3)$$

$$= -\sqrt{2}\ (\sin\Delta\theta - \cos\Delta\theta)\sin(\theta + \theta_2 + 45°)$$

Where $\theta_1$ and $\theta_2$ are constant.

Consequently, when the aspect ratio of the tube is 5:3, $\Delta\theta$ becomes 14.0° and $S_1$:$S_2$ becomes 5:3. Then, it follows that $$S_1 = \sqrt{2} \times 1.21 \times \sin(\theta + \theta_1 + 45°) \quad (4)$$

$$S_2 = \sqrt{2} \times 0.73 \times \sin(\theta + \theta_2 + 45°) \quad (5)$$

The area of the electrodes H+, H− becomes 1.21 times as large as that of the prior art (refer to formula 1) and the increase of the deflection sensitivity over the prior art is 1.21.

When the aspect ratio is 4:3, $\Delta\theta$ becomes 8.1° and $S_1$:$S_2$ becomes 4:3. Then the area of the electrodes H+ and H− will be 1.13 times as large as that of the prior art and the increase of the deflection sensitivity becomes 1.13 of that of the prior art.

FIG. 2 is drawn for the dimensions for the case where the aspect ratio is 5:3 and where $\Delta\theta$ is 14.0°. In FIG. 2 the hatched portions are surplus portions which do not cause any problems because the surface portions are averaged in the axial direction between the electrodes H+ and H− and between the electrodes V+ and V− in a manner similar to that in FIG. 6.

Thus, in the embodiment of the invention, the ratio of the areas of the electrodes H+ and H− to the areas of the electrodes V+ and V− becomes nearly equal to the aspect ratio. That is, the deflection sensitivity in the respective directions becomes nearly equal to the aspect ratio. Consequently, the deflection sensitivity in the direction of the larger deflection angle which is the horizontal direction in the illustrated embodiment increases in comparison to that of the prior art. Consequently, for the patterns of the electrode G3 in the illustrated embodiment, the deflection source voltage is decreased and, therefore, the power consumption is decreased, and the breakdown voltage of the circuit elements can be selected to be lower than in the prior art. For example, when the deflection sensitivity is increased 1.21 times, the source voltage or the breakdown voltage may be decreased 1/1.21.

Figure 3:
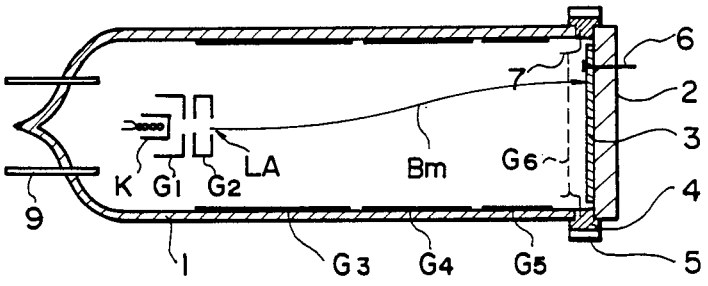
FIG. 3 is a sectional view of an image pickup tube of the electrostatic focus/electrostatic deflection type.

Although the embodiment is illustrated is applied to an image pick-up tube of the magnetic focus/electrostatic deflection type, the invention may be also applied to an image pickup tube of the electrostatic focus/electrostatic deflection type illustrated in FIG. 3. FIG. 3 illustrates a third grid electrode G3, fourth grid electrode G4 and a fifth grid electrode G5. The electrodes G3, G4 and G5 are made in a process that metal such as chromium is evaporated or plated on the inner surface of the glass bulb 1 and then prescribed patterns are formed by means of cutting using a laser beam or the like. Electrodes G3–G5 constitute the focusing electrode system for focusing the electron beam $B_m$ and the electrode G4 also serves as the deflection electrode for the electron beam $B_m$. An electrode G6 is a mesh electrode. The other parts illustrated in FIG. 3 are the same as those illustrated in FIG. 4.

In FIG. 3, the patterns of the electrode G4 are formed with the patterns illustrated in FIG. 1 or FIG. 2 of the invention and the working effect is the same as that described with reference to FIG. 4.

The image can be applied not only to image pickup tubes but also to cathode ray tubes such as storage tubes or scan converter tubes.

According to the invention described, since the deflection sensitivity in the vertical direction and the horizontal direction is made to be equal to the deflection aspect ratio, the deflection sensitivity in the direction of larger deflection angles increases as compared to the prior art. Accordingly, the deflection source voltage is decreased and the power consumed is decreased and the breakdown voltage of circuit elements can be selected to be lower than those of the prior art.

Although the invention has been described with respect to preferred embodiments, it is not to be so limited as changes and modifications can be made therein which are within the full intended scope as defined by the appended claims.

I claim as my invention:

1. A cathode ray tube of the electrostatic deflection type, comprising a glass bulb, an electron beam source, and vertical deflection electrodes and horizontal deflection electrodes which are formed in patterns and applied to the inner surface of the glass bulb, wherein the ratio of the area of said horizontal deflection electrodes to the area of said vertical deflection electrodes is substantially equal to the aspect ratio of the deflection of the electron beam which is greater than one.

2. A cathode ray tube according to claim 1 wherein said vertical and horizontal deflection electrodes are formed in a leaf pattern.

3. A cathode ray tube according to claim 1 wherein said vertical and horizontal deflection electrodes are formed in an arrow pattern.

4. A cathode ray tube of the electrostatic deflection type, comprising a glass bulb, an electron beam source, and vertical deflection electrodes and horizontal deflection electrodes which are formed in patterns and applied to the inner surface of the glass bulb, wherein the ratio of the area of said horizontal deflection electrodes to the area of said vertical deflection electrodes is substantially equal to the aspect ratio of the deflection of the electron beam, and wherein the aspect ratio of deflection of the electron beam is 5:3 and the ratio of the area of said horizontal deflection electrodes to the area of said vertical deflection electrodes is approximately 5:3.

5. A cathode ray tube of the electrostatic deflection type, comprising a glass bulb, an electron beam source, and vertical deflection electrodes and horizontal deflection electrodes which are formed in patterns and applied to the inner surface of the glass bulb, wherein the ratio of the area of said horizontal deflection electrodes to the area of said vertical deflection electrodes is substantially equal to the aspect ratio of the deflection of the electron beam, and wherein the aspect ratio of deflection of the electron beam is 4:3 and the ratio of the area of said horizontal deflection electrodes to the area of said vertical deflection electrodes is approximately 4:3.

* * * * *